US011740584B2

(12) United States Patent
Tanabe et al.

(10) Patent No.: US 11,740,584 B2
(45) Date of Patent: Aug. 29, 2023

(54) IMAGE FORMING APPARATUS AND METHOD FOR PRODUCING DRIVE UNIT

(71) Applicant: CANON KABUSHIKI KAISHA, Tokyo (JP)

(72) Inventors: Yuichi Tanabe, Chiba (JP); Yuki Kurosu, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/724,211

(22) Filed: Apr. 19, 2022

(65) Prior Publication Data

US 2022/0342361 A1 Oct. 27, 2022

(30) Foreign Application Priority Data

Apr. 26, 2021 (JP) ..... 2021-073857

(51) Int. Cl.
*G03G 15/00* (2006.01)
*G03G 21/16* (2006.01)

(52) U.S. Cl.
CPC ..... *G03G 21/1671* (2013.01); *G03G 15/80* (2013.01); *G03G 21/168* (2013.01); *G03G 21/1619* (2013.01); *G03G 21/1647* (2013.01); *G03G 2221/1657* (2013.01)

(58) Field of Classification Search
CPC ..... G03G 15/80; G03G 21/1619; G03G 15/1647; G03G 15/1671; G03G 15/168; G03G 15/1857; G03G 2221/1657
See application file for complete search history.

(56) References Cited

U.S. PATENT DOCUMENTS

2016/0274530 A1 9/2016 Tanabe et al. ..... G03G 21/1619
2016/0378050 A1* 12/2016 Yamamoto ..... G03G 21/1647 399/167
2017/0139369 A1* 5/2017 Matsuno ..... G03G 15/80
2017/0330546 A1* 11/2017 Ishida ..... G03G 21/1619
2022/0187757 A1 6/2022 Tanabe et al. ..... G03G 21/186

FOREIGN PATENT DOCUMENTS

JP 2007-155072 6/2007
JP 2016-102885 6/2016

OTHER PUBLICATIONS

U.S. Appl. No. 17/720,874, filed Apr. 14, 2022.

* cited by examiner

*Primary Examiner* — Sophia S Chen
(74) *Attorney, Agent, or Firm* — Venable LLP

(57) ABSTRACT

An image forming apparatus includes a support frame, a driving device including a first supporting portion configured to hold the drive source on a first surface and configured to rotatably support the drive gear on a second surface, and a second supporting portion configured to support the drive gear with the first supporting portion, a board holding member disposed in a manner overlapping the first supporting portion in a rotational axis direction of the drive gear, and a third supporting portion disposed between the first supporting portion and the board holding member in the rotational axis direction, and configured to support the board holding member, one end of the third supporting portion being fixed to a side of the first surface of the first supporting portion by a first fastening member, another end of the third supporting portion being fixed to the board holding member by a second fastening member.

13 Claims, 8 Drawing Sheets

FIRST STEP

SECOND STEP

THIRD STEP

FOURTH STEP

IMAGE FORMING APPARATUS AND METHOD FOR PRODUCING DRIVE UNIT

BACKGROUND OF THE INVENTION

Field of the Invention

This disclosure relates to an image forming apparatus, such as a printer, a copier, a facsimile, and a multifunction machine, which uses an electrophotographic technique.

Description of the Related Art

A drive roller or the like so as to rotatably drive, for example, a photosensitive drum, developing sleeve, and intermediate transfer belt, serving as a rotary member, is disposed in an apparatus body of an image forming apparatus such as a printer, a copier, a facsimile, and a multifunction machine integrally combining those functions mentioned above. Further, so as to drive such a rotary member, a driving device integrating a motor and drive gear is mounted on a back side plate of the image forming apparatus. Further, so as to miniaturize the image forming apparatus, for example, an electrical board such as a power supply control board for supplying power and a main control board for performing various control processes related to an image forming operation is disposed in a manner overlapping the driving device (refer to Japanese Patent Laid-Open No. 2016-102885).

As described in Japanese Patent Laid-Open No. 2016-102885, hitherto, so as to dispose the electrical board in a manner overlapping the driving device, the electrical board is fastened by a screw to a projecting piece cut and raised from a flat portion of a metal support plate supporting a drive transmission device. Therefore, a through hole is perforated in the support plate at the base of the projecting piece.

Incidentally, while a fastening hole for fastening the screw is formed in the projecting piece described above, the metal powder generated at the formation of the fastening hole in the projecting piece sometimes remains in the fastening hole as shavings. In a case of the apparatus described in the patent literature 1 described above, when the screw is inserted into the fastening hole for fastening, it is possible that the metal powder pushed out from the fastening hole by the screw enters into the driving device through the through hole in the support plate so as to attach to the drive gear and the like. If the metal powder attaches to the drive gear, a rotational fluctuation may occur in the rotary member driven by the driving device. Therefore, it is possible that image defects such a periodic band shaped density unevenness (called banding and the like) occur. Further, when a foreign substance attached to the drive gear is bitten by the drive gear, an occurrence of an abnormal noise is caused.

SUMMARY OF THE INVENTION

The present disclosure provides the image forming apparatus capable of suppressing the image defects and the occurrence of the abnormal noise caused by the attachment of the foreign substance to the drive gear attendant upon fastening the screw at disposing the electrical board in a manner overlapping the drive unit.

According to a first aspect of the present invention, an image forming apparatus forming an image on a recording material, the image forming apparatus includes a support frame configured to support a rotary member, a driving device including a drive source, a drive gear configured to transmit driving force of the drive source to the rotary member, a first supporting portion configured to hold the drive source on a first surface and configured to rotatably support the drive gear on a second surface opposite of the first surface, and a second supporting portion configured to form a space for storing the drive gear with the first supporting portion and configured to support the drive gear with the first supporting portion, a board holding member disposed in a manner overlapping the first supporting portion in a rotational axis direction of the drive gear, and configured to hold an electrical board, and a third supporting portion disposed between the first supporting portion and the board holding member in the rotational axis direction, and configured to support the board holding member, one end of the third supporting portion being fixed to a side of the first surface of the first supporting portion by a first fastening member, another end of the third supporting portion being fixed to the board holding member by a second fastening member.

According to a second aspect of the present invention, a method for producing a drive unit, the method includes fixing the drive source and the third supporting portion to the first supporting portion, wherein the drive unit includes a support frame configured to support a rotary member, the drive source, a drive gear configured to transmit a driving force of the drive source to the rotary member, the first supporting portion configured to hold the drive source on a first surface and configured to rotatably support the drive gear on a second surface opposite of the first surface, a second supporting portion configured to form a space for storing the drive gear with the first supporting portion and configured to support the drive gear with the first supporting portion, a board holding member disposed in a manner overlapping the first supporting portion when viewed in a rotational axis direction of the drive gear and configured to hold an electrical board, and the third supporting portion disposed between the first supporting portion and the board holding member in the rotational axis direction and configured to support the board holding member, one end of the third supporting portion being fixed to a side of the first surface of the first supporting portion by a first fastening member, another end of the third supporting portion being fixed to the board holding member by a second fastening member, fixing the second supporting portion to the first supporting portion in a state where the drive gear is supported by the first supporting portion and the second supporting portion, and fixing the board holding member to the third supporting portion.

Further features of the present invention will become apparent from the following description of exemplary embodiments with reference to the attached drawings.

DESCRIPTION OF THE EMBODIMENTS

Image Forming Apparatus

Figure 1:
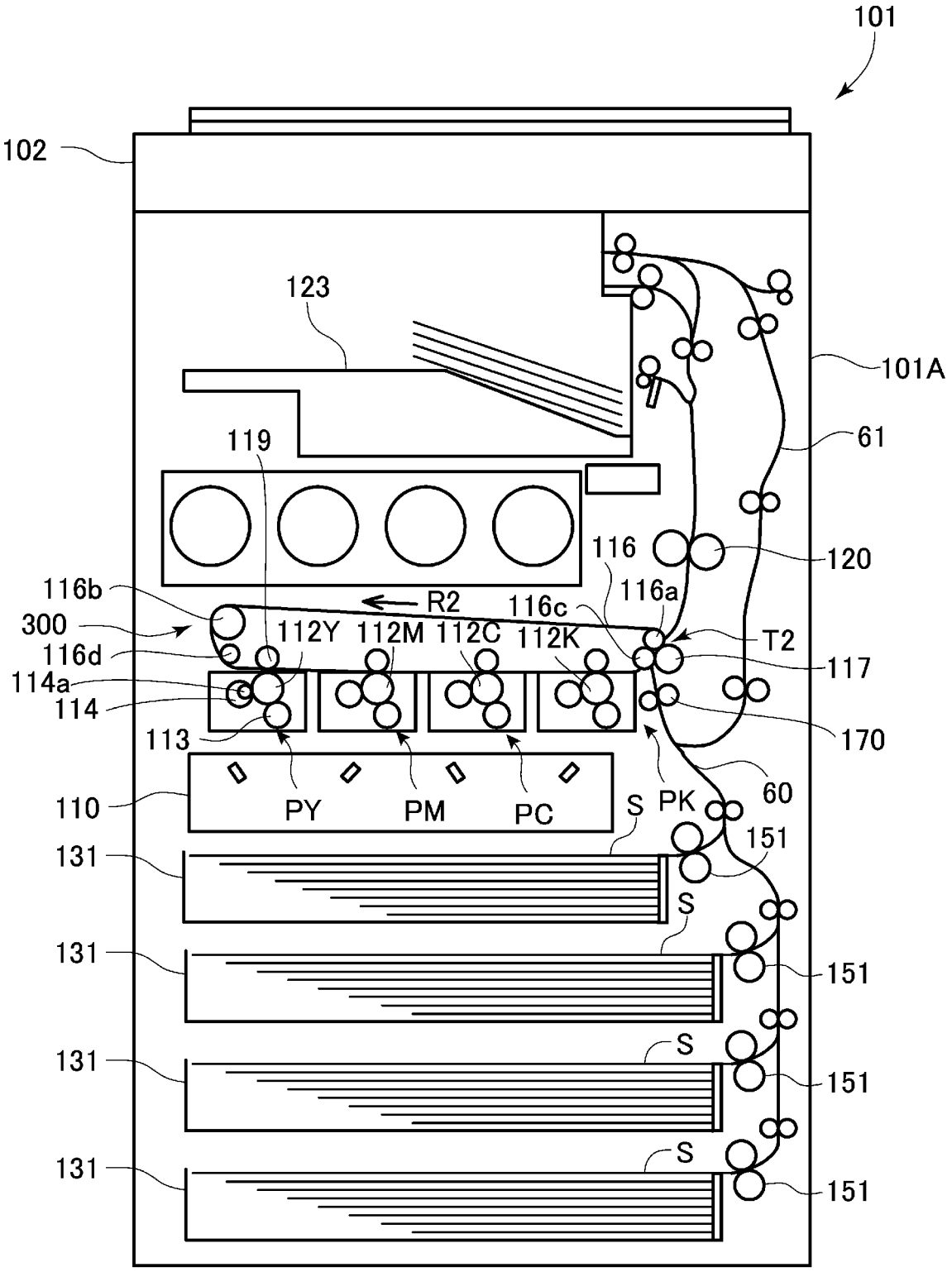
FIG. 1 is a schematic diagram showing an image forming apparatus of this embodiment.

An image forming apparatus of this embodiment will be described using FIGS. 1 and 2. The image forming apparatus 101 shown in FIG. 1 is a full color printer of an intermediate transfer system. The image forming apparatus 101 includes image forming units PY, PM, PC, and PK respectively forming toner images of yellow, magenta, cyan, and black. The image forming apparatus 101 forms the toner image on a recording material S in accordance with an image signal from a document reading apparatus 102 disposed on an upper side in the vertical direction or an external apparatus, not shown, such as personal computer. The recording material S includes a sheet material such as paper, a plastic film, cloth, and the like. To be noted, herein, a side on which a user stands at the time of operating an operation panel, not shown, so as to operate the image forming apparatus 101 is referred to as "front", and the opposite side is referred to as "back".

In the image forming apparatus 101 shown in FIG. 1, the image forming units PY, PM, PC, and PK are disposed alongside in a moving direction (arrow R2 direction) of an intermediate transfer belt 116. The intermediate transfer belt 116 is an endless belt member so as to bear and convey the toner images primarily transferred from photosensitive drums 112Y, 112M, 112C, and 112K of the respective image forming units PY, PM, PC, and PK. The intermediate transfer belt 116 is stretched over respective rotary members, namely a secondary transfer inner roller 116*a*, a tension roller 116*b*, a pre-secondary transfer roller 116*c*, and a stretch roller 116*d*. Further, the intermediate transfer belt 116 is moved in the moving direction by the secondary transfer inner roller 116*a* (rotary member, secondary transfer roller) rotatably driven by a driving device 90 (refer to FIG. 3) described later. That is, in this embodiment, the secondary transfer inner roller 116*a* also serves as a drive roller driving the intermediate transfer belt 116.

The image forming apparatus 101 includes a support frame body 101A supporting the units, such as the photosensitive drums 112Y to 112K, the secondary transfer inner roller 116*a*, the tension roller 116*b*, the pre-secondary transfer roller 116*c*, and the stretch roller 116*d*. The support frame body 101A is constructed by a plurality of sheet metals and the like, such as a front side plate disposed on the front side of the image forming apparatus 101, a back side plate disposed on the back side and supporting the respective units with the front side plate, a stay for coupling the front and back side plates to each other, and a support column for supporting the front side plate, and covered by an exterior cover, not shown, composing an appearance of the image forming apparatus 101.

A secondary transfer outer roller 117 is disposed in a manner facing the secondary transfer inner roller 116*a* across the intermediate transfer belt 116, and forms a secondary transfer nip portion T2 for transferring the toner image on the intermediate transfer belt 116 onto the recording material S. The secondary transfer inner and outer rollers 116*a* and 117 are rotatably driven so as to nip and convey the recording material S in the secondary transfer nip portion T2.

One or a plurality of cassettes 131 storing the recording material S are disposed in a lower side of the image forming apparatus 101. The recording material S stored in the cassette 131 is supplied one sheet at a time to a conveyance path 60 by a feed roller 151 in the timing synchronizing with image formation. The recording material S is conveyed to a registration roller 170 disposed in the conveyance path 60, and, after the registration roller 170 has corrected skew and the timing, is conveyed toward the secondary transfer nip portion T2. The cassette 131 is slidably supported with respect to the support frame body 101A. The user is able to replenish the recording material S by drawing the cassette 131 out to the front side of the image forming apparatus 101.

The four image forming units PY, PM, PC, and PK included in the image forming apparatus 101 are substantially the same in a configuration except for differences in colors used in developing units 114 included in the respective image forming units. Accordingly, only the image forming unit PY of yellow will be described herein as a representative, and descriptions of the other image forming units PM, PC, and PK will be omitted.

The photosensitive drum 112Y, serving as one of the rotary members, is disposed in the image forming unit PY. The photosensitive drum 112Y is rotatably driven by the driving device 90 (refer to FIG. 3) described later. A charge unit 113, the developing unit 114, and a primary transfer roller 119 are disposed around the photosensitive drum 112Y.

In a case where an image forming operation has been started, first, a surface of the rotating photosensitive drum 112Y is uniformly charged by the charge unit 113. Then, the photosensitive drum 112Y is scanned and exposed with a laser beam irradiated from an exposing unit 110 shared among the image forming units PY to PK. Thereby, an electrostatic latent image in accordance with the image signal is formed on the photosensitive drum 112Y. The electrostatic latent image on the photosensitive drum 112Y is developed by a toner (developer) inside the developing unit 114, and toner image is formed on the photosensitive drum 112Y. The developing unit 114 includes a conveyance screw (not shown) circularly conveying the developer inside a developer container and a developing sleeve 114*a* (rotary member) supplying the developer to the photosensitive drum 112Y by rotating while bearing the developer. The developing sleeve 114*a* is driven by the driving device 90 (refer to FIG. 3) described later.

The toner image formed on the photosensitive drum 112Y is primarily transferred from the photosensitive drum 112Y onto the intermediate transfer belt 116 in a primary transfer portion formed between the photosensitive drum 112Y and the primary transfer roller 119 disposed so as to face each other across the intermediate transfer belt 116. At this time, a primary transfer voltage is applied to the rotating primary transfer roller 119. Thereby, the intermediate transfer belt 116 is rotatably driven while bearing the toner image transferred from the photosensitive drum 112Y.

By performing the operations described above in the respective image forming units PY to PK of yellow, magenta, cyan, and black in sequence, it is possible to form the toner image on the intermediate transfer belt 116. For example, it is possible to form a monochromic toner image or the toner image of a desired color by appropriately superimposing some of four colors. The recording material S supplied from the cassette 131 is conveyed to the secondary transfer nip portion T2 via the registration roller 170 in the timing synchronizing with the formation of the toner image described above. Then, for example, by applying a secondary transfer voltage to the secondary transfer outer roller 117 by a high voltage power source, not shown, the toner image on the intermediate transfer belt 116 is secondarily transferred onto the recording material S when the recording material S passes through the secondary transfer nip portion T2.

The recording material S onto which the toner image has been transferred from the intermediate transfer belt 116 is conveyed to a fixing unit 120. The fixing unit 120 fixes the toner image on the recording material S by providing the recording material S with heat and pressure while nipping and conveying the recording material S. In a case of a simplex printing mode forming the toner image only on one side of the recording material S, the recording material S on which the toner image has been fixed by the fixing unit 120 is discharged to a recording material discharge portion 123. On the other hand, in a case of a duplex printing mode forming the toner image on both sides of the recording material S, after the toner image has been fixed on the one side by the fixing unit 120, the recording material S is inverted by switchback conveyance, and conveyed toward the registration roller 170 via a duplex conveyance path 61. After the toner image has been formed on the other side of the recording material S by the fixing unit 120 via a process similar to the case of the simplex printing mode, the recording material S is discharged to the recording material discharge portion 123.

In a case of this embodiment, the intermediate transfer belt 116, the secondary transfer inner roller 116*a*, the tension roller 116*b*, the pre-secondary transfer roller 116*c*, the stretch roller 116*d*, and the plurality of primary transfer rollers 119 form an intermediate transfer unit 300.

To be noted, the image forming apparatus 101 is capable of forming not only a multicolor image but also a black monochrome image by using only the image forming unit PK. In a case of forming the black monochrome image, the primary transfer rollers 119 other than the primary transfer roller 119 of black are separated from the intermediate transfer belt 116 by a primary transfer roller separation mechanism, not shown, driven by the driving device 90 (refer to FIG. 3) described later.

Figure 2:
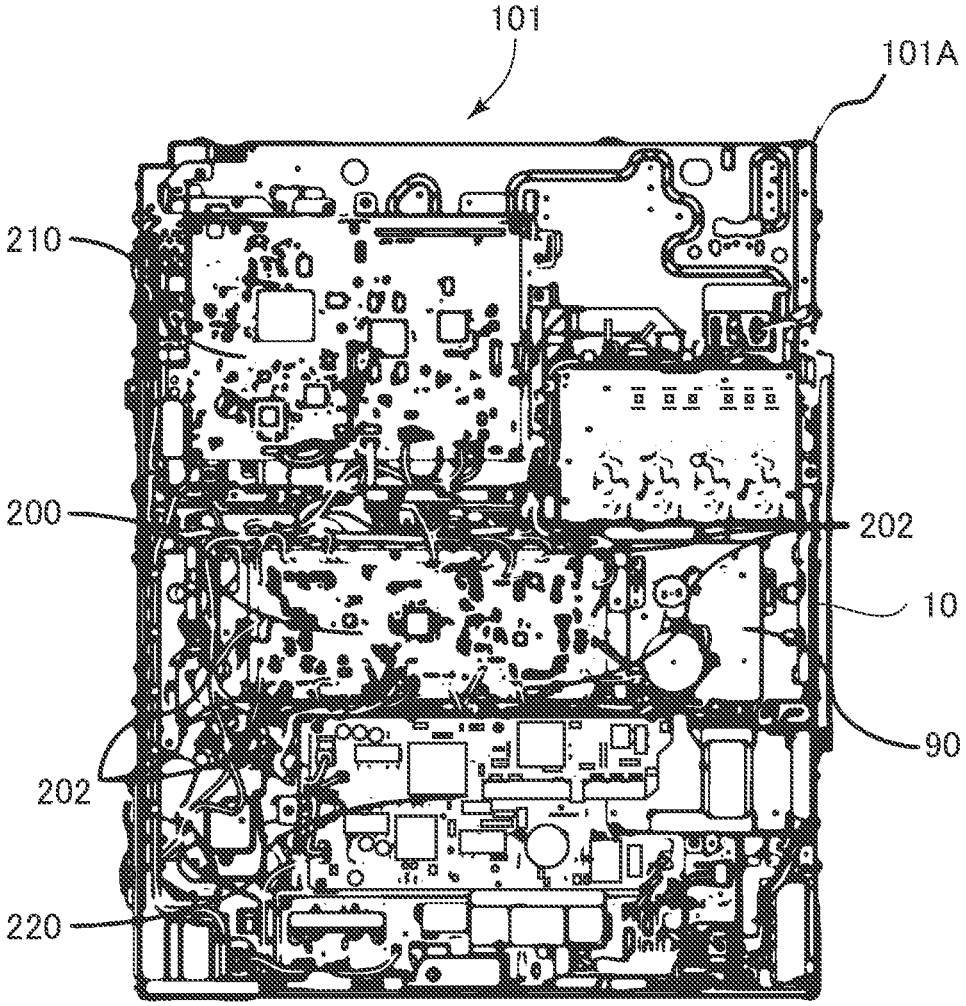
FIG. 2 is a schematic diagram showing a back side of the image forming apparatus.

FIG. 2 is a schematic diagram showing the back side of the image forming apparatus 101 of this embodiment. In the image forming apparatus 101, an operation panel, not shown, is disposed on the front side to facilitate a user's operation, and the driving device 90 is disposed on the back side. In a case of this embodiment, the driving device 90 is capable of driving the photosensitive drum 112 and the secondary transfer inner roller 116*a*, shown in FIG. 1, the primary transfer roller separation mechanism (not shown) and the developing unit 114 (in particular, the developing sleeve 114*a*). The driving device 90 is mounted on a back side plate 10.

Further, a variety of electrical boards (electric system units) are disposed on the back side of the image forming apparatus 101. The electrical board is a board on which, for, example, a central processing unit (CPU), a memory, an electronic component, an electrical component, a connector, and the like are mounted. The electrical boards include, for example, a drive control board 200 driving a motor and the like, a main control board 210 transmitting and receiving a variety of control signals (electric signals) in accordance with the execution of programs such as an image formation job, a power control board 220 performing a voltage adjustment and the like by receiving a power supply from an external power source, and the like. The main control board 210 is coupled to the drive control board 200, the power control board 220, and the like in a manner capable of transmitting and receiving the electric signals through a wire harness 202. To be noted, the electrical boards are not limited to those described above.

In this embodiment, so as to miniaturize the image forming apparatus 101, at least one of those electrical boards is disposed in a manner overlapping the driving device 90. In an example shown in FIG. 2, the drive control board 200 is disposed on the driving device 90 in a manner overlapping the driving device 90. A disposition configuration of the electrical board on the driving device 90 as described above in this embodiment is described later (refer to FIGS. 7A to 8D).

Outline of Drive Unit

Referring to FIG. 1, the driving device 90 will be described using FIGS. 3 to 6. To be noted, so as to facilitate the understanding of descriptions, the illustration of part or all of the disposition configuration (refer to FIGS. 7A and 7B) of the electrical board to the driving device 90 described later are omitted in FIGS. 3 to 6.

The driving device 90 includes a main supporting body 20, serving as a first supporting portion, formed by, for example, a sheet metal and a sub-supporting body 25 (refer to FIG. 5), serving as a second supporting portion, made of metal. In this embodiment, the driving device 90 is fixed to the outside of the support frame body 101A, instead of the inside of the support frame body 101A of the image forming apparatus 101. At this point, the outside of the support frame body 101A indicates a side covered by the external cover described above. Accordingly, since the driving device 90 becomes accessible by removing the external cover of the image forming apparatus 101, it is easier to perform maintenance work by this configuration in comparison with a configuration in which the driving device 90 is fixed to the inside of the support frame body 101A.

Figure 3:
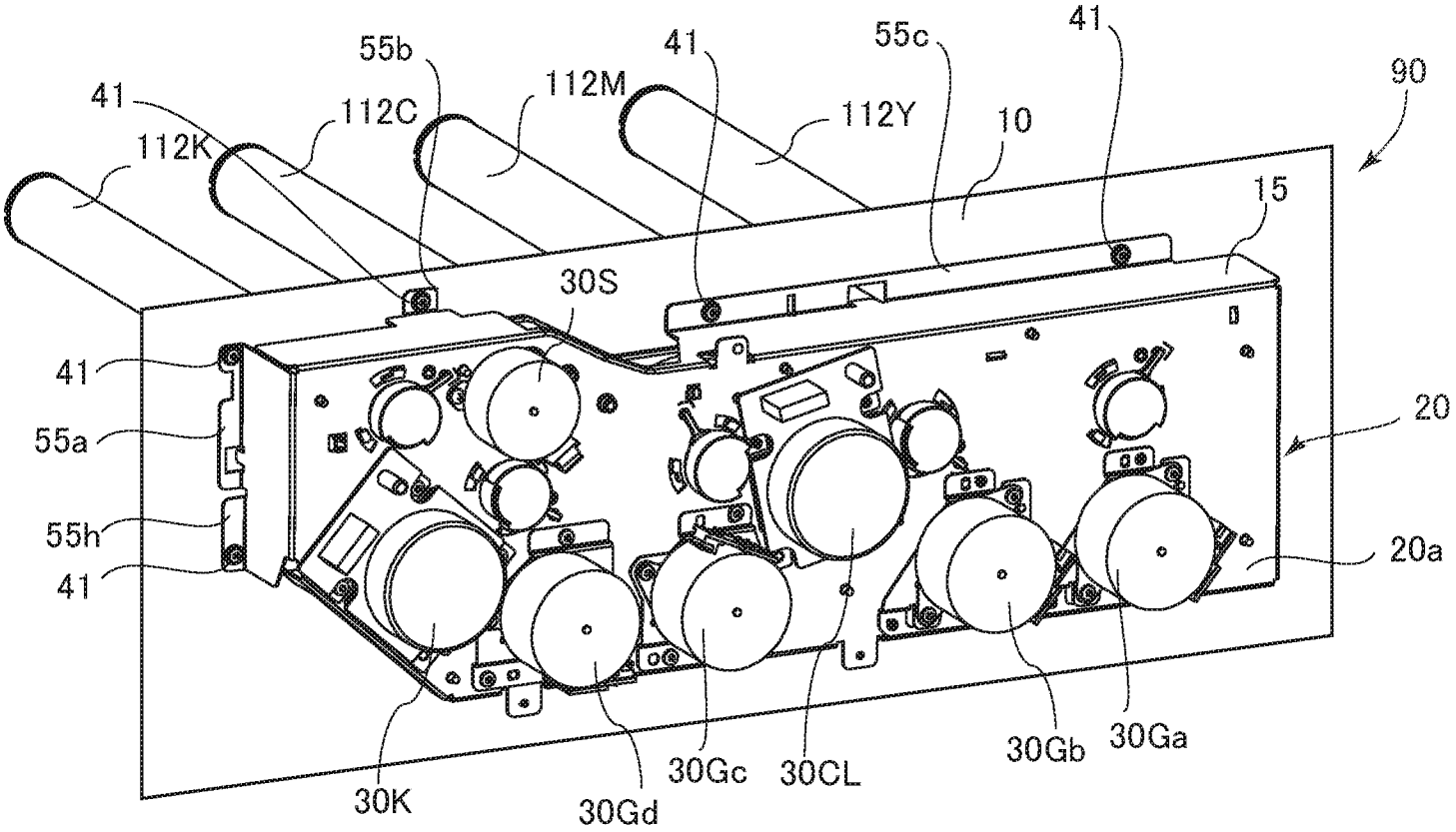
FIG. 3 is a perspective view showing a driving device.
Figure 4:
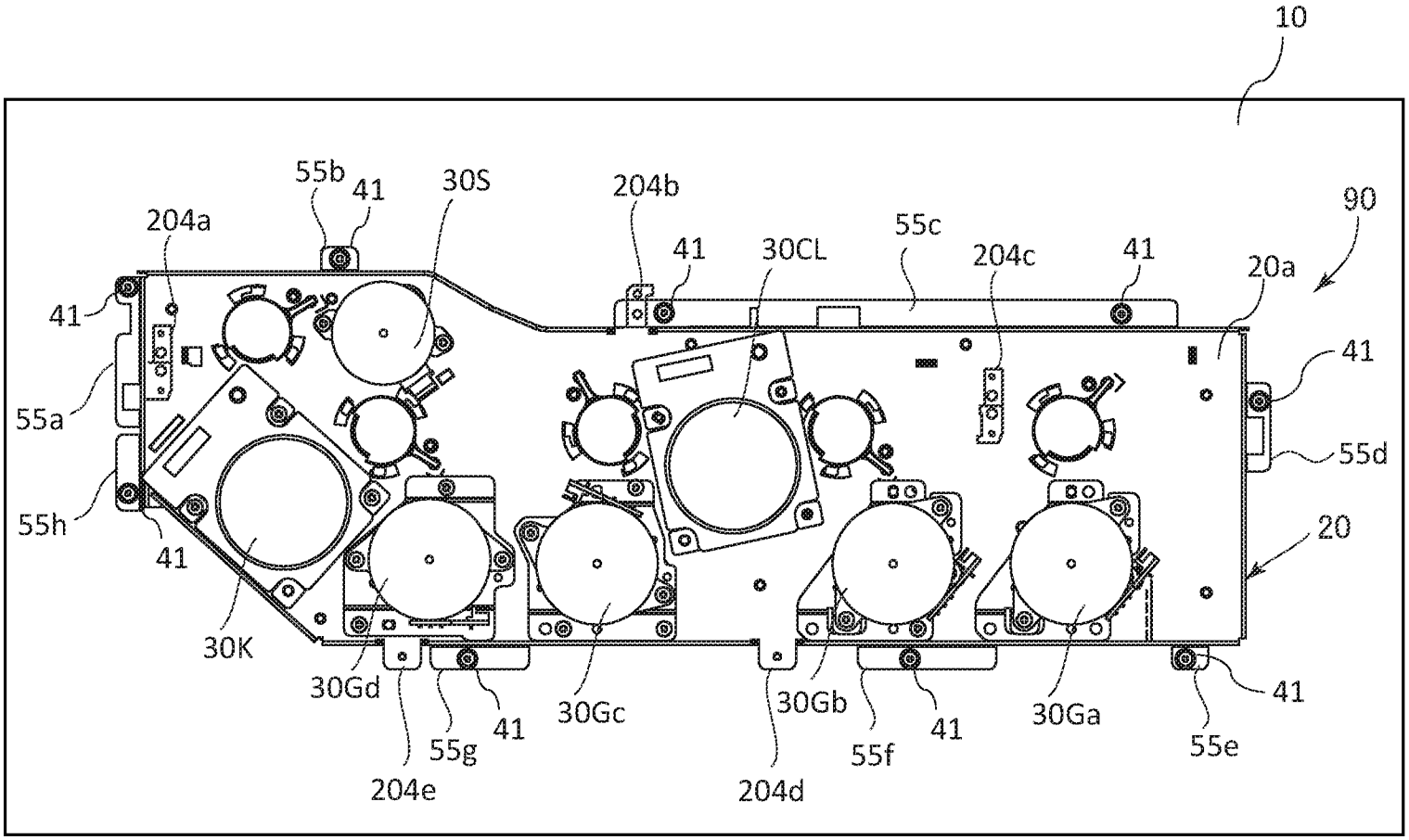
FIG. 4 is a diagram showing the driving device when viewed from a side of a main supporting body.

As shown in FIGS. 3 and 4, the driving device 90 is mounted on the back side plate 10 of the support frame body 101A (refer to FIG. 1). The driving device 90 is fixed to the back side plate 10 by screws 41 via a plurality of fixing portions 55*a* to 55*h* formed on a circumference of the main support body 20 in a manner disposing the sub-supporting body 25 on a side of the back side plate 10. Mounting holes to fit the screws 41 for fastening to the apparatus body are formed in the fixing portions 55*a* to 55*h*.

On the main supporting body 20, as shown in FIG. 3, an outer circumferential wall 15 is disposed upright toward the back side plate 10 in a manner enclosing the outer circumference so as to prevent a foreign substance such as dust from entering from the outside into the inside of the driving device 90 in which drive gears (refer to FIG. 5) are disposed. The fixing portions 55*a* to 55*h* are formed by bending into an L shape with respect to a wall surface of the outer circumferential wall 15 so as to bring an edge of the outer circumferential wall 15 into contact with the back side plate 10. Therefore, it is possible to fix the fixing portions 55*a* to 55*h* to the back side plate 10 by the screw 41. To be noted, in a case where an opening is formed due to a difficulty in sheet metal processing of a configuration to continuously dispose the outer circumferential wall 15, it is acceptable to close the opening with a sheet material and the like.

Further, as shown in FIGS. 3 and 4, a plurality of motors 30CL, 30K, 30S, and 30Ga to 30Gd, serving as drive sources to drive the rotary members rotatably supported by the back side plate 10, are held on a side of a first surface of the main supporting body 20. Here, the one motor 30CL for driving the photosensitive drums 112Y, 112M, and 112C of yellow, magenta, and cyan, and the one motor 30K for driving the photosensitive drums 112K of black and the secondary transfer inner roller 116*a* are held. Further, the one motor 30S for driving the primary transfer roller separation mechanism (not shown) and, further, the four motors 30Ga, 30Gb, 30Gc, and 30Gd for individually driving each of the developing units 114 (in particular, developing sleeves 114*a*) of yellow, magenta, cyan, and black are held.

Figure 5:
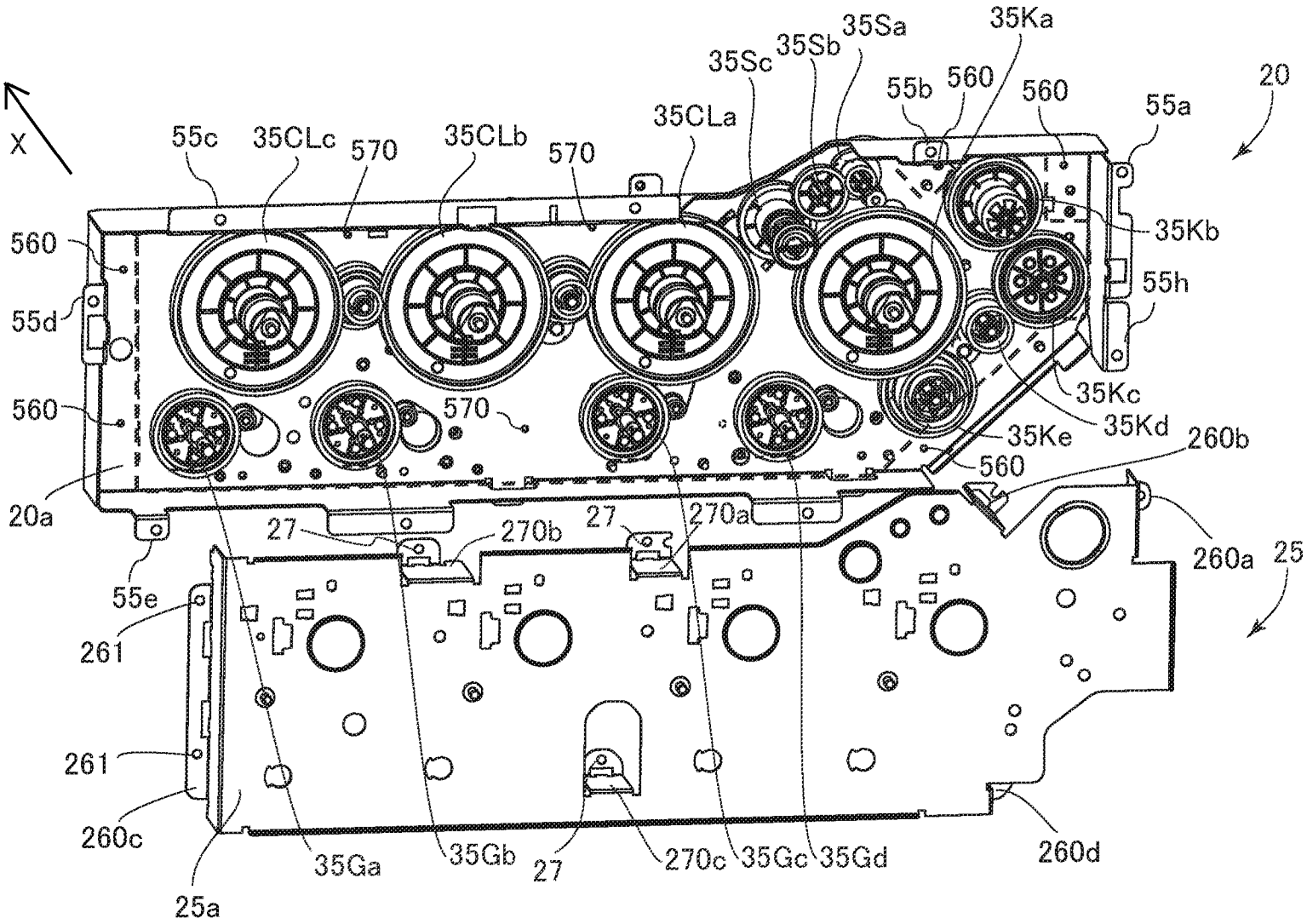
FIG. 5 is an exploded perspective view showing the driving device.

On the other hand, as shown in FIG. 5, drive gears 35CLa to 35CLc, 35Ka to 35Ke, 35Sa to 35Sc, and 35Ga to 35Gd for transmitting the driving force of the motors 30CL, 30K, 30S, and 30Ga to 30Gd to the rotary members in the support frame body 101A are disposed on a side of a second surface opposite of the first surface of the main supporting body 20. The drive gears 35CLa to 35CLc transmit the driving force of the motor 30CL to the photosensitive drums 112Y, 112M, and 112C of yellow, magenta, and cyan. The drive gears 35Ka to 35Ke transmit the driving force of the motor 30K to the photosensitive drum 112K of black and the secondary transfer inner roller 116*a*. Further, the drive gears 35Sa to 35Sc are disposed so as to transmit the driving force of the motor 30S to the primary transfer roller separation mechanism (not shown), and the drive gears 35Ga to 35Gd are disposed so as to respectively transmit the driving force of the four motors 30Ga to 30Gd to the developing units 114 (in particular, the developing sleeves 114*a*) of yellow, magenta, cyan, and black. Viscous grease is coated on gear teeth surfaces of these drive gears 35CLa to 35CLc, 35Ka to 35Ke, 35Sa to 35Sc, and 35Ga to 35Gd so as to secure lubricity and quietness during rotation.

The drive gears 35CLa to 35CLc include couplings for transmitting the drive to the photosensitive drums 112Y, 112M, and 112C of yellow, magenta, and cyan. The drive gears 35Ka to 35Ke include couplings for transmitting the drive to the photosensitive drum 112K of black and the secondary transfer inner roller 116*a*. These couplings are exposed from through holes disposed in a second supporting portion 25*a* of the sub-supporting body 25, and capable of transmitting the driving force to the respective units. On the other hand, in the drive gears 35CLa to 35CLc and 35Ka to 35Ke, the part including teeth surfaces for transmitting the drive is disposed within a space covered by the main supporting body 20 and the sub-supporting body 25. The drive gears 35Ga to 35Gd are disposed within the space covered by the main supporting body 20 and the sub-supporting body 25, and the other gears, to which the driving force of the drive gears 35Ga to 35Gd are transmitted, and couplings, to which the driving force is transmitted from these other gears, are disposed outside the sub-supporting body 25 so as to transmit the driving force to the four developing units 114. These couplings project from the through holes disposed in the back side plate 10 of the support frame body 101A to the inside of the support frame body 101A, so that these couplings are capable of transmitting the driving force to the respective units supported by the support frame body 101A.

The main supporting body 20 and the sub-supporting body 25 are disposed at both ends of the drive gears 35CLa to 35CLc, 35Ka to 35Ke, 35Sa to 35Sc, and 35Ga to 35Gd in rotational axis directions of the drive gears, and each rotatably support the rotation shafts of the drive gears. The main supporting body 20 includes the first supporting portion 20*a* supporting first ends of the rotation shafts of the drive gears, and the sub-supporting body 25 includes the second supporting portion 25*a* supporting second ends of the rotation shafts of the drive gears. While, in this embodiment, in the first and second supporting portions 20*a* and 25*a*, the drive gears 35CLa to 35CLc, 35Ka to 35Ke, 35Sa to 35Sc, and 35Ga to 35Gd are supported on the same planes, it is acceptable that there is unevenness, a step, or the like in either one or both of the first and second supporting portions 20*a* and 25*a*.

These main supporting body 20 and the sub-supporting body 25 are disposed so as to sandwich the drive gears 35CLa to 35CLc, 35Ka to 35Ke, 35Sa to 35Sc, and 35Ga to 35Gd, and are coupled to each other. In the case of this embodiment, the main supporting body 20 has a larger area and higher stiffness than the sub-supporting body 25. Therefore, in this embodiment, the sub-supporting body 25 is fastened to the main supporting body 20 by screw 40 (distinguished from the screw 41 for fastening to the apparatus body, refer to FIG. 6). The sub-supporting body 25 is disposed upstream of the main supporting body 20 in a fastening direction (inserting direction, in arrow X direction in FIG. 5) in which the screw 40 is fastened.

In the main supporting body 20, out-of-plane fastening holes 560 and in-plane fastening holes 570 for fastening the screws 40 are formed in the first supporting portion 20*a*. On the other hand, in the sub-supporting body 25, out-of-plane fitting portions 260*a* to 260*d* and in-plane fitting portions 270*a* to 270*d* are formed so as to insert and fit the screws 40.

A fastening configuration of the main supporting body 20 and the sub-supporting body 25 by the screw 40 in the driving device 90 will be described. The in-plane fastening holes 570 for fastening the screws 40 are formed in the first supporting portion 20*a* of the main supporting body 20, and the in-plane fitting portions 270*a* to 270*d* for inserting and fitting the screws 40 are formed in the sub-supporting body 25. In the first supporting portion 20*a*, the in-plane fastening holes 570 are formed within a projection plane obtained by projecting the second supporting portion 25*a* of the sub-supporting body 25 in the rotational axis directions of the drive gears 35CLa to 35CLc, 35Ka to 35Ke, 35Sa to 35Sc, and 35Ga to 35Gd (refer to FIG. 5). The projection plane of the second supporting portion 25*a* is a projection plane obtained by projecting a circumference drawn by connecting outermost edges of a surface supporting the drive gears 35CLa to 35CLc, 35Ka to 35Ke, 35Sa to 35Sc, and 35Ga to 35Gd, and is indicated by broken lines in FIGS. 5 and 6.

On the other hand, as shown in FIG. 5, the in-plane fitting portions 270*a* to 270*d* of the sub-supporting body 25 are extended from the second supporting portion 25*a* toward a downstream side (side of the first supporting portion 20*a*) in the fastening direction of the screw 40 so as to come into contact with the first supporting portion 20*a* within the projection plane. Further, in a contact portion coming into contact with the first supporting portion 20*a*, in-plane fitting holes 27 for inserting and fitting the screws 40 are formed in the in-plane fitting portions 270*a* to 270*d* at positions overlapping the in-plane fastening holes 570 of the main supporting body 20. These in-plane fitting portions 270*a* to 270*d* are formed in such a manner that part of the sub-supporting body 25 is cut and bent toward a side of the main supporting body 20 (side of the first supporting portion 20*a*).

In the case of this embodiment, the main supporting body 20 is fixed to the back side plate 10 in a state where the sub-supporting body 25 faces the back side plate 10 (support frame) of the support frame body 101A (refer to FIG. 1). Then, in a state where the main supporting body 20 and the sub-supporting body 25 are coupled to each other, a tip of the screw 40 (in particular, a tip of a screw portion) projects from the downstream side of the in-plane fastening hole 570 in the fastening direction. However, in the case of this embodiment, in the state where the main supporting body 20 and the sub-supporting body 25 are coupled to each other, when viewed from the gravity direction, a downstream end of the in-plane fastening hole 570 in the fastening direction (on a back side of a fastening portion) does not overlap the space sandwiched between the first and second supporting portions 20*a* and 25*a*. That is, the downstream end of the in-plane fastening hole 570 in the fastening direction is located outside the driving device 90 so as not to overlap the respective drive gears 35CLa to 35CLc, 35Ka to 35Ke, 35Sa to 35Sc, and 35Ga to 35Gd disposed between the first and second supporting portions 20*a* and 25*a*.

Figure 6:
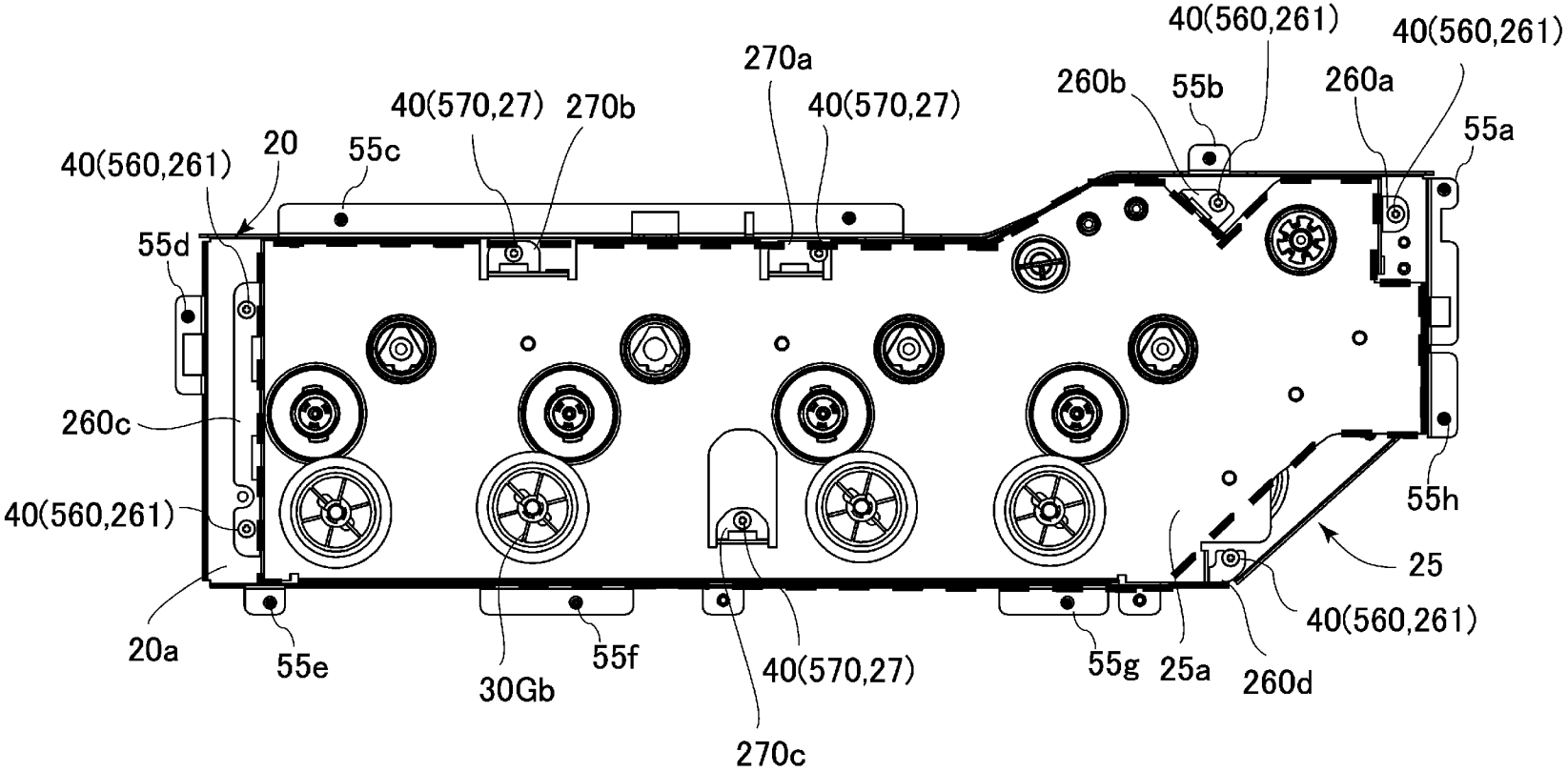
FIG. 6 is a diagram showing the drive unit when viewed from a side of a sub-supporting body.

Further, in the case of this embodiment, as shown in FIG. 6, in the main supporting body 20, the out-of-plane fastening holes 560 for fastening the screw 40 are formed outside the projection plane of the second supporting portion 25*a*. On the other hand, in the sub-supporting body 25, the out-of-plane fitting portions 260*a* to 260*d* are extended from the second supporting portion 25*a* toward the downstream side (side of the first supporting portion 20*a*) in the fastening direction of the screw 40 so as to come into contact with the first supporting portion 20*a* outside the projection plane. Out-of-plane fitting holes 261 are formed in the out-of-plane fitting portions 260*a* to 260*d* so as to insert and fit the screw 40. That is, in this embodiment, so as to affix the sub-supporting body 25 to the main supporting body 20 more firmly, it is possible to fix the sub-supporting body 25 to the main supporting body 20 also at the out-of-plane fitting portions 260*a* to 260*d* disposed at positions different from the in-plane fitting portions 270*a* to 270*d*. These out-of-plane fitting portions 260*a* to 260*d* and the in-plane fitting portions 270*a* to 270*d* are disposed inside the circumference of the first supporting portion 20*a* so as to come into contact with the first supporting portion 20*a* of the main supporting body 20.

Disposition Configuration of Control Board to Driving Device

In this embodiment, the electrical board (as an example, the drive control board 200) is disposed in a manner overlapping the driving device 90 (refer to FIG. 2). Therefore, referring to FIGS. 4 and 5, using FIGS. 7A to 8D, a disposition configuration of the electrical board on the driving device 90 will be described taking for example the drive control board 200.

Figure 7A:
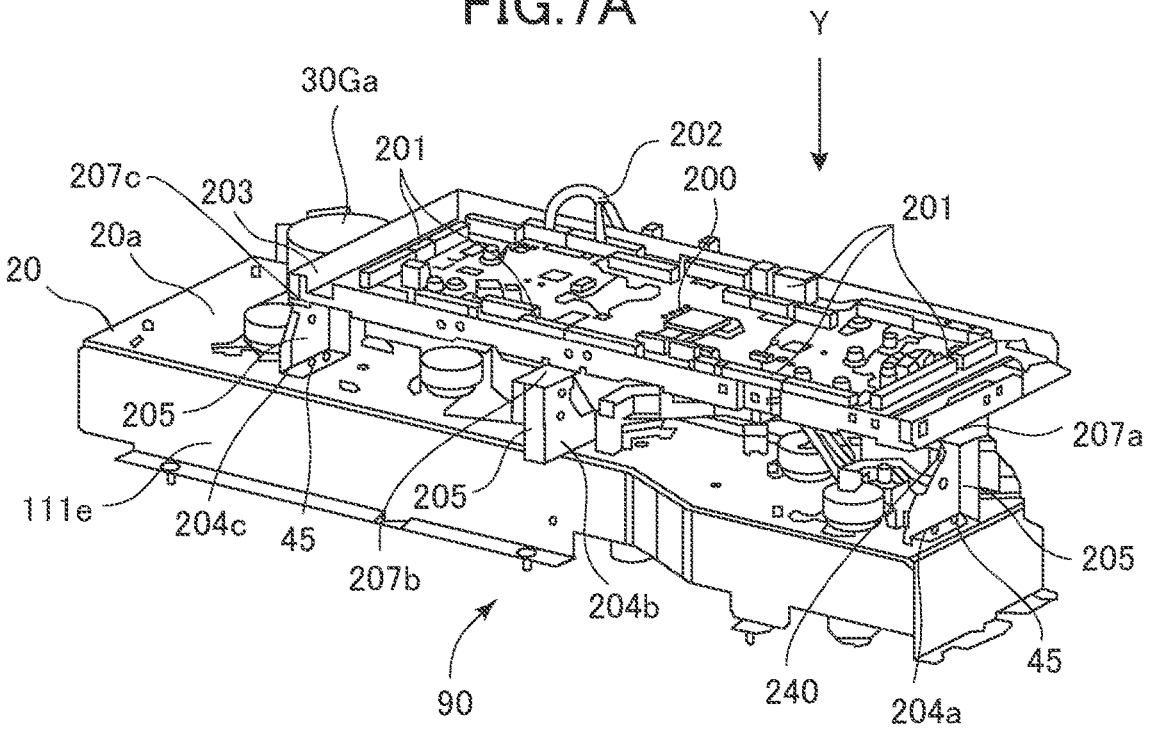
FIG. 7A is a perspective view showing a drive control board disposed on the driving device when viewed from above.
Figure 7B:
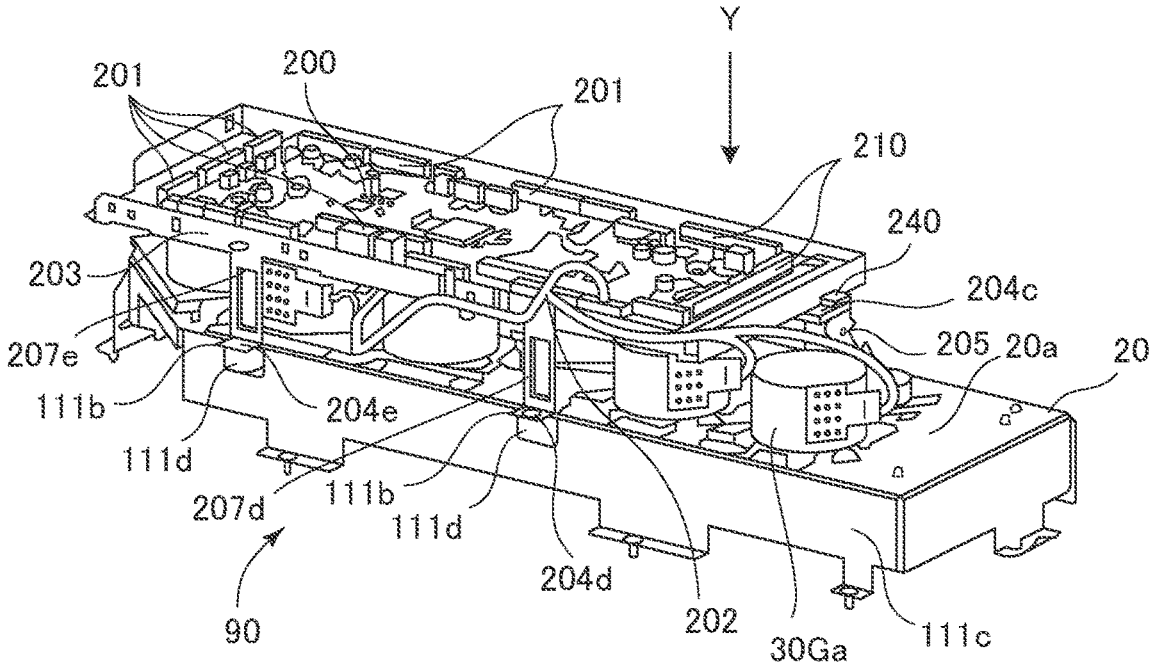
FIG. 7B is a perspective view showing the drive control board disposed on the driving device when viewed from below.

As shown in FIGS. 7A and 7B, the drive control board 200 is disposed on the back of the driving device 90. The drive control board 200 taken for example is a board which controls, for example, movements of the motors 30CL, 30K, 30S, and 30Ga to 30Gd (refer to FIG. 4) of the driving device 90, a fan and conveyance motors, not shown, and the like. The drive control board 200 includes a plurality of connectors 201, and, by being coupled to the main control board 210 and the respective motors via the wire harnesses 202 which are detachable from the connectors 201, controls the movements of the respective motors in accordance with the control performed by the main control board 210. From a viewpoint of the workability of the insertion/removal into and from the wire harnesses 202, the connectors 201 are dispersedly disposed as much as possible within a mounting surface of the drive control board 200. Since, thereby, overlaps among the wire harnesses 202 are reduced, it is favorable that the workability of the insertion/removal into and from the wire harnesses 202 is improved.

Incidentally, if installation spaces dedicated to all of the respective electrical boards (the main control board 210 and the power control board 220) including the drive control board 200 are disposed, it is difficult to avoid an increase in the size of the image forming apparatus 101, and contrary to a recent need for miniaturization. Therefore, as shown in FIGS. 7A and 7B, by disposing at least one of the plurality of the electrical boards (the drive control board 200 in this embodiment) in a manner overlapping the driving device 90, it is possible to achieve a disposition of the electrical boards, taking into consideration a current space, without increasing the size of the image forming apparatus 101. In this embodiment, the drive control board 200 is disposed in a manner overlapping the driving device 90 when viewed from the rotational axis directions (arrow Y direction) of the drive gears 35CLa to 35CLc, 35Ka to 35Ke, 35Sa to 35Sc, and 35Ga to 35Gd (refer to FIG. 5).

To be noted, it is acceptable to dispose the electrical board (the main control board 210, the power control board 220) other than the drive control board 200 on the driving device 90, and, if there is a space in the driving device 90 for disposing the plurality of electrical boards, it is acceptable to dispose the plurality of electrical boards on the driving device 90. In such a case, it is acceptable to dispose the electrical boards on the driving device 90 by appropriately combining the electrical boards taking into consideration an area of the driving device 90 and areas of the plurality of respective electrical boards.

However, particularly, it is preferred that the drive control board 200 controlling the motors 30CL, 30K, 30S, and 30Ga to 30Gd disposed in the driving device 90 and the like disposed in the driving device 90 is disposed on the driving device 90. That is, since the numerous wire harnesses 202 are coupled to the drive control board 200 in comparison with the other electrical boards so as to control the plurality of motors and the like, it is preferred that the drive control board 200 is disposed on the driving device 90 disposed on the middle level of the support frame body 101A (refer to FIG. 2). Thereby, it is possible to shorten lengths of the numerous wire harnesses 202, and simplify the wire processing of those wire harnesses 202. If it is possible to shorten the wire harnesses 202, it is possible to suppress an effect of external noise on signals transmitted and received through the wire harness 202, and possible to realize the cost reduction.

In the case of this embodiment, the drive control board 200 is disposed on the driving device 90 in a state preassembled to and held by a board holding plate 203, serving as a board holding member. Thereby, since the drive control board 200 is attached to and detached from the driving device 90 in a state of being held by the board holding plate 203 having higher stiffness in comparison with the electrical board, it is possible for a worker to perform the attachment and detachment easily. Further, since it becomes difficult for a tool used at the attachment and detachment to hit the drive control board 200, it is possible to suppress the breakage of the drive control board 200 caused by a hit with the tool at the attachment and detachment. To be noted, while, in a case where the plurality of electrical boards are disposed on the driving device 90, it is preferred that those plurality of electrical boards are held by one board holding plate 203, it is acceptable to hold each of the plurality of electrical boards by a separate board holding plate 203. Further, it is acceptable to detachably hold the electrical board such as the drive control board 200 by the board holding plate 203.

Further, in this embodiment, so as to mount the board holding plate 203 onto the driving device 90 with a screw, a plurality of holding plate fastening portions 204*a*, 204*b*, 204*c*, 204*d*, and 204*e* are formed in the main supporting body 20 (refer to FIGS. 4, 7A, and 7B). For the purpose of allowing the worker to easily attach and detach the board holding plate 203, the holding plate fastening portions 204*a* to 204*e* are formed outside the board holding plate 203 so as not to overlap the board holding plate 203 (refer to FIG. 8D).

Incidentally, in the case where the drive control board 200 is disposed in a manner overlapping the driving device 90, it is necessary to space the drive control board 200 so as not to come into contact with the motors 30CL, 30K, 30S, and 30Ga to 30Gd (refer to FIG. 4) and the like. Hitherto, as already described, part of the first supporting portion 20*a* is cut and bent toward a side of the board holding plate 203, so that a projecting piece projecting from the first supporting portion 20*a* toward the board holding plate 203 is formed. In this case, a through hole is formed at a base of the projecting piece in the first supporting portion 20*a*. Therefore, it is possible that, at a time of inserting the screw into the fastening hole formed in the projecting piece and fastening the board holding plate 203, a metal powder pushed out from the fastening hole by the screw enters into the driving device 90 and attaches to the drive gears 35CLa to 35CLc, 35Ka to 35Ke, 35Sa to 35Sc, and 35Ga to 35Gd (refer to FIG. 5). The metal powder attached to the drive gear is undesirable since the metal powder causes image defects such as the density unevenness of the image formed on the recording material and an occurrence of an abnormal noise.

In view of this, in this embodiment, as shown in FIG. 7A, at the holding plate fastening portions 204*a* to 204*c* disposed above the drive gears in the gravity direction, the board holding plate 203 is mounted to the driving device 90 through a plurality (three in this embodiment) of support columns 205. The support columns 205, serving as a third supporting portion, are separate members disposed independently from the driving device 90 and the board holding plate 203, and are sandwiched between the driving device 90 (in particular, the first supporting portion 20*a*) and the board holding plate 203 at positions of the holding plate fastening portions 204*a* to 204*c*. One ends of the respective support columns 205 are fixed to the holding plate fastening portions 204*a* to 204*c* by screws 45 (refer to FIG. 7A), serving as a first fastening member. Then, the other ends of the respective support columns 205 are fixed to fixing portions 207*a* to 207*c* of the board holding plate 203 by screws 46 (refer to FIG. 8D), serving as a second fastening member. By disposing the support columns 205, which are the separate members, as described above, it is possible to fix the board holding plate 203 to the main supporting body 20 at the holding plate fastening portions 204*a* to 204*c* on an upper side in the gravity direction without forming the through holes in the first supporting portion 20*a* as before.

On the other hand, as shown in FIG. 7B, the holding plate fastening portions 204*d* and 204*e* disposed below the drive gears in the gravity direction are formed such that part of a lower surface 111*c* (in other words, on a lower surface side of the outer circumferential wall 15 of the main supporting body 20) is cut and bent toward the side of the board holding plate 203. Surfaces 111*e* (see FIG. 7A) and 111*b* are side surfaces of main supporting body 20. Further, fixing portions 207*d* and 207*e* projecting toward the holding plate fastening portions 204*d* and 204*e* are disposed in the board holding plate 203 for fixing by a screw. While through holes 111*d* are formed in the lower surface 111*c* by the formation of the holding plate fastening portions 204*d* and 204*e*, if the through holes 111*d* are formed in the lower surface 111*c*, the holding plate fastening portions 204*d* and 204*e* are located below the drive gears 35CLa to 35CLc, 35Ka to 35Ke, 35Sa to 35Sc, and 35Ga to 35Gd (refer to FIG. 5) in the gravity direction. Therefore, it is not possible that a foreign substance (metal powder) enters into the driving device 90 from the through holes 111*d*. Thus, at the holding plate fastening portions 204*d* and 204*e*, the board holding plate 203 is fixed to the main supporting body 20 by the screw without using the support column 205 described above.

To be noted, it is acceptable to use the support columns 205 at all of the fixing portions fixing the board holding plate 203 and the main supporting body 20 to each other without forming the through hole in the main supporting body 20 as described above. However, if there is not a possibility that the foreign substance enters into the driving device 90 from the through hole, as described above, since cost reduction due to the decrease in a number of components is expected, it is advantageous to form the holding plate fastening portions 204*d* and 204*e* as described above so as to make it possible to fasten without using the support column 205.

Further, as shown in FIGS. 7A and 7B, it is acceptable to dispose latch portions 240 in the board holding plate 203 so as to temporarily pre-hold the board holding plate 203 at the support columns 205 by hooking the support columns 205. Alternatively, it is acceptable to dispose the latch portions 240 in the support columns 205. Thereby, since it is possible to pre-hold the board holding plate 203 at the time when the worker fastens the board holding plate 203 to the support columns 205 during maintenance or other work, the workability is improved. To be noted, in a state where the board holding plate 203 is fixed to the support columns 205 by the screw 46, the board holding plate 203 is fixed to the main supporting body 20 by the screw 45 in an area overlapping the board holding plate 203 so as not allow the worker to access the screw 45 fixing the support columns 205 and the main supporting body 20 to each other. That is, if the worker has not removed the board holding plate 203 from the support columns 205 beforehand, it is not possible to remove the support columns 205 from the main supporting body 20. Thereby, since the worker does not accidentally remove the support columns 205 from the main supporting body 20 during the maintenance or other work, the metal powder associated with fastening the screw is not generated, and does not enter into the driving device 90.

Disposition Procedure

Next, a disposition procedure of the drive control board 200 (in particular, the board holding plate 203) to the driving device 90 will be described step by step using FIGS. 8A to 8D. To be noted, so as to facilitate the understanding of descriptions, the illustration of part of the screws, the motor 30S, and the like is omitted in FIGS. 8A to 8D.

Figure 8A:
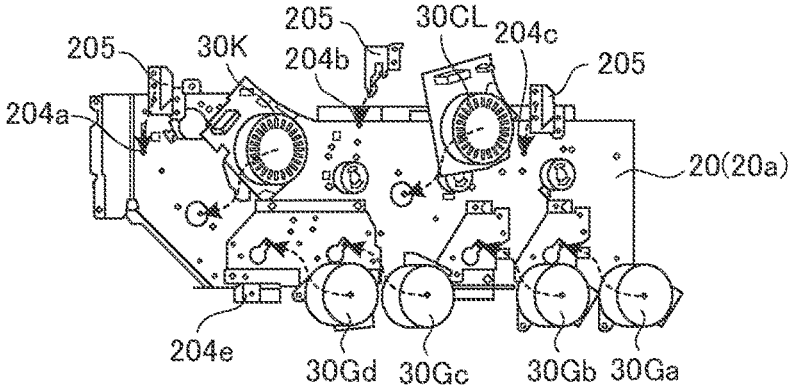
FIGS. 8A, 8B, 8C, and 8D are diagrams for explaining disposition procedures of the drive control board, and respectively illustrate a first, second, third, and fourth steps.
Figure 8B:
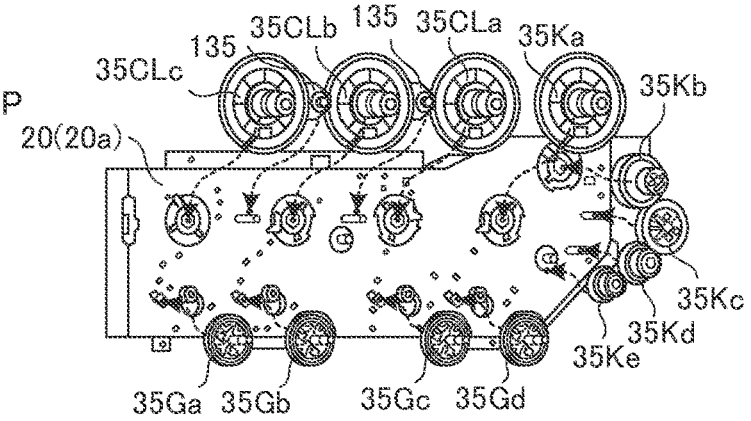

First, as shown in FIG. 8A, as a first step, the motors 30CL, 30K, and 30Ga to 30Gd and the support columns 205 are fixed to the first supporting portion 20*a* onto which the sub-supporting body 25 has not been mounted. At this time, one ends of the support columns 205 are fastened to the holding plate fastening portions 204*a* to 204*c* described above by the screw. Then, as shown in FIG. 8B, as a second step, the drive gears 35CLa to 35CLc, 35Ka to 35Ke, and 35Ga to 35Gd are mounted onto the side of the second surface, opposite of the first surface onto which the motors and the support columns 205 have been fastened, of the first supporting portion 20*a*. Thereby, since the motors and the support columns are fastened by the screw prior to mounting the drive gears, even if the metal powder is generated during the fastening, the metal powder does not attach to the drive gears.

Figure 8C:
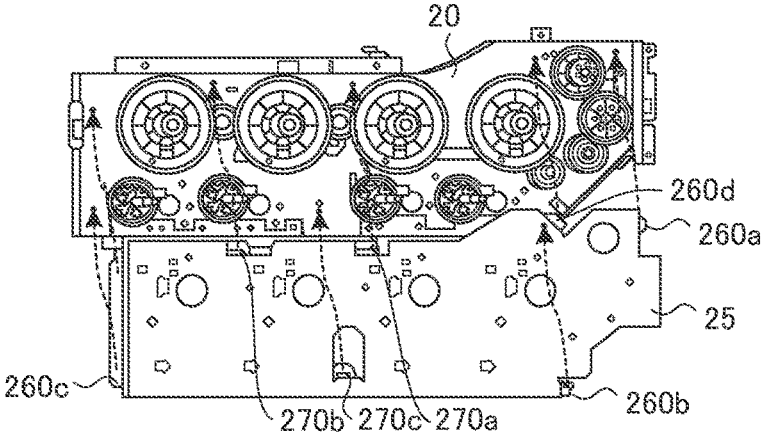

Then, as shown in FIG. 8C, as a third step, the sub-supporting body 25 is fastened to the main supporting body 20 by the screw. At this point, as described above, in the case of this embodiment, the tip of the screw projects from the downstream side of the in-plane fastening hole 570 in the fastening direction. Therefore, even if the metal powder is generated due to the fastening by the screw, since such metal powder is pushed out to the outside of the driving device 90, the metal powder does not attach to the drive gears.

Figure 8D:
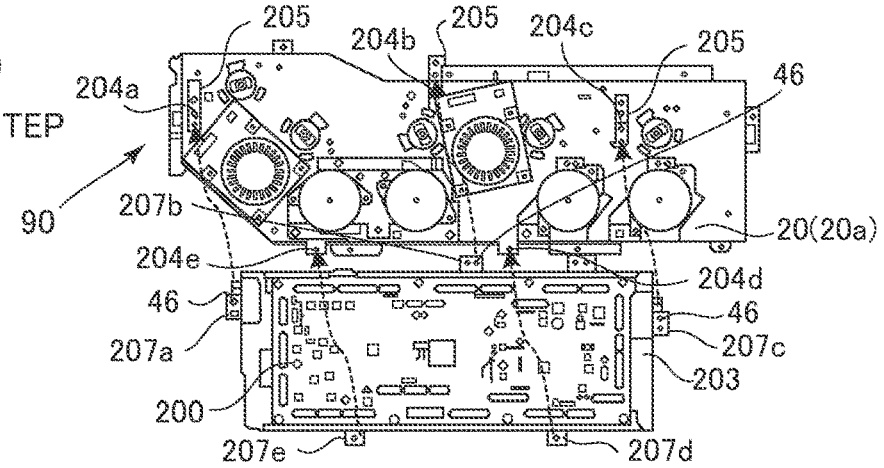

Next, as shown in FIG. 8D, as a fourth step, the drive control board 200 is mounted onto the driving device 90 in the state where the drive control board 200 is held by the board holding plate 203. The board holding plate 203 is fastened to the other ends of the support columns 205 with the screws through the fixing portions 207*a* to 207*c*, and also fastened to the holding plate fastening portions 204*d* and 204*e* by the screws through the fixing portions 207*d* and 207*e*. Thus, the upper side of the board holding plate 203 is fastened by using the support columns 205 which are the separate bodies provided separately from the main supporting body 20, and the lower side of the board holding plate 203 is fastened to the holding plate fastening portions 204*d* and 204*e* formed by cutting the main supporting body 20.

As described above, in the case disposing the electrical board in a manner overlapping the driving device 90, the board holding plate 203 holding the electrical board is fastened by the screw by using the support columns 205 provided separately from the main supporting body 20. In this embodiment, by using the support columns 205, which are the separate bodies, and by fastening the board holding plate 203 to the support columns 205 by the screw, it is possible to mount the support columns 205 prior to mounting the drive gears 35CLa to 35CLc, 35Ka to 35Ke, 35Sa to 35Sc, and 35Ga to 35Gd. Thereby, it is not necessary to directly fasten the first supporting portion 20*a* supporting the drive gears by the screw at the time of fastening the board holding plate 203 to the driving device 90. Further, it is not necessary to fasten to the projection piece cut and raised from the main supporting body 20 toward the side of the board holding plate 203 by the screw as before. Therefore, even if the metal powder is generated due to fastening the board holding plate 203 by the screw, since, in the main supporting body 20, there is not a through hole adjacent to the portions to which the board holding plate 203 is fastened, the metal powder does not enter into the driving device 90. Therefore, the metal powder generated due to fastening by the screw does not attach to the drive gears, and the image defects such as the density unevenness in the image formed on the recording material and the abnormal noise do not occur.

Other Embodiment

To be noted, while, in the embodiment described above, a configuration example in which the support column 205 is fastened to the board holding plate 203 by the screw is described, it is not limited to this. For example, if the support column 205 is the separate body from the board holding plate 203, it is acceptable to fix the support column 205 to the board holding plate 203 by welding. Even in such a configuration, since the support column 205 is the separate body from the board holding plate 203, the metal powder does not enter into the driving device 90. Therefore, the metal powder generated due to the fastening by the screw does not attach to the drive gears, and the image defects such as the density unevenness in the image formed on the recording material and the abnormal noise do not occur.

To be noted, while, in the embodiment described above, an example of the image forming apparatus 101 of the intermediate transfer system in which the toner image is secondarily transferred onto the recording material S after the toner images have been primarily transferred from the respective photosensitive drums 112Y to 112K to the intermediate transfer belt 116 is described, it is not limited to this. The embodiment described above is applicable to an image forming apparatus of a direct transfer system in which the toner image is directly transferred from the photosensitive drums 112Y to 112K, which rotate while bearing the toner images, of the respective colors onto the recording material S.

By this disclosure, with a simple configuration, it is possible to achieve the suppression of the occurrences of the image defects and the abnormal noise caused by the generation of the foreign substance at fastening the fastening member in the configuration disposing the electrical board in a manner overlapping the driving device and by the attachment of the foreign substance to the drive gears.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-073857, filed Apr. 26, 2021, which is hereby incorporated by reference herein in its entirety.

What is claimed is:

1. An image forming apparatus forming an image on a recording material, the image forming apparatus comprising:

a support frame configured to support a rotary member;

a driving device including a drive source, a drive gear configured to transmit driving force of the drive source to the rotary member, a first supporting portion configured to support the drive source on a first side with respect to the first supporting portion in a rotational axis direction of the drive gear and configured to rotatably support the drive gear on a second side opposite to the first side with respect to the first supporting portion in the rotational axis direction of the drive gear, and a second supporting portion configured to form a space for storing the drive gear with the first supporting portion and configured to support the drive gear with the first supporting portion;

a board supporting member disposed in a manner that the board supporting member overlaps the first supporting portion when the boar supporting member is viewed along the rotational axis direction of the drive gear, and configured to hold an electrical board; and a third supporting portion configured to support the board supporting member, one end of the third supporting portion being fixed to the first supporting portion, another end of the third supporting portion being fixed to the board supporting member by a screw.

2. The image forming apparatus according to claim 1, wherein at least one of the board supporting member and the third supporting portion includes a latch portion configured to latch the board supporting member for temporarily pre-supporting the board supporting member with respect to the third supporting portion in a state where the board supporting member is not fixed by the screw.

3. The image forming apparatus according to claim 1, wherein the driving device is configured to be fixed to the support frame in such a manner that the second supporting portion faces the support frame.

4. The image forming apparatus according to claim 1, wherein the electrical board includes a board configured to control the drive source.

5. The image forming apparatus according to claim 1, wherein the rotary member includes a photosensitive drum configured to be rotatably driven while bearing a toner image.

6. The image forming apparatus according to claim 1, wherein the rotary member includes a developing sleeve configured to be rotatably driven while bearing a toner so as to develop a toner image on a photosensitive drum.

7. The image forming apparatus according to claim 1, wherein the rotary member includes a secondary transfer roller configured to form a nip portion for secondarily transferring a toner image onto the recording material from an intermediate transfer belt onto which the toner image formed on a photosensitive drum has been primarily transferred.

8. The image forming apparatus according to claim 1, wherein the one end of the third supporting portion being fixed to a surface of the first supporting portion on the first side, the surface intersecting with the rotational axis direction of the drive gear.

9. The image forming apparatus according to claim 1, wherein the one end of the third supporting portion is fixed to the first supporting portion by a second screw.

10. The image forming apparatus according to claim 9, wherein the third supporting portion is fixed within an area in which the first supporting portion overlaps the board supporting member when the board supporting member is viewed along the rotational axis direction so as not to allow access to the second screw in a state where the board supporting member is fixed by the screw.

11. The image forming apparatus according to claim 9, wherein the third supporting portion is fixed to the first supporting portion by the second screw in a position above the drive gear in a gravity direction.

12. The image forming apparatus according to claim 1, wherein the one end of the third supporting portion is fixed to the first supporting portion by welding.

13. A method for producing a drive unit, the method comprising:

fixing a drive source and a third supporting portion to a first supporting portion, wherein the drive unit includes a support frame configured to support a rotary member, the drive source, a drive gear configured to transmit driving force of the drive source to the rotary member, the first supporting portion configured to support the drive source on a first side with respect to the first supportin portin in a rotational axis direction of the drive gear and configured to rotatably support the drive gear on a second side opposite to the first side with respect to the first supporting portion in the rotational axis direction of the drive gear, a second supporting portion configured to form a space for storing the drive gear with the first supporting portion and configured to support the drive gear with the first supporting portion, a board supporting member disposed in a manner that the board supporting member overlaps the first supporting portion when the board supporting member is viewed along the rotational axis direction of the drive gear and configured to support an electrical board, and the third supporting portion configured to support the board supporting member, one end of the third supporting portion being fixed to the first supporting portion, another end of the third supporting portion being fixed to the board supporting member by a second fastening member;

fixing the second supporting portion to the first supporting portion in a state where the drive gear is supported by the first supporting portion and the second supporting portion; and fixing the board supporting member to the third supporting portion.

* * * * *